US007971863B2

(12) United States Patent
Chen et al.

(10) Patent No.: US 7,971,863 B2
(45) Date of Patent: Jul. 5, 2011

(54) CLAMPING APPARATUS WITH POSITION VALIDATION FUNCTION AND CLAMPING PROCESS USING SAME

(75) Inventors: Chien-Hung Chen, Hsinchu (TW); Chen-Hsing Cheng, Hsinchu (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 931 days.

(21) Appl. No.: 11/873,222

(22) Filed: Oct. 16, 2007

(65) Prior Publication Data

US 2008/0265479 A1 Oct. 30, 2008

(30) Foreign Application Priority Data

Apr. 27, 2007 (TW) ..... 96114919 A

(51) Int. Cl.
*B25B 11/00* (2006.01)

(52) U.S. Cl. ..... 269/8; 269/45; 269/43; 269/289 R

(58) Field of Classification Search ..... 269/8, 54.1, 269/54.3, 908, 289 R, 58, 45, 43; 248/346.3
See application file for complete search history.

(56) References Cited

U.S. PATENT DOCUMENTS 3,849,857 A * 11/1974 Murray, Jr. ..... 269/60
4,485,339 A * 11/1984 Trost ..... 318/640
4,506,205 A * 3/1985 Trost et al. ..... 318/653
4,507,597 A * 3/1985 Trost ..... 318/653
4,784,377 A * 11/1988 Woodward ..... 269/21
5,026,033 A * 6/1991 Roxy ..... 269/45
5,031,547 A * 7/1991 Hirose ..... 108/140
5,163,651 A * 11/1992 Matsumoto ..... 248/425
5,660,381 A * 8/1997 Suzuki ..... 269/73
6,190,997 B1 * 2/2001 Becker et al. ..... 438/401
6,811,131 B2 * 11/2004 Kuo ..... 248/346.03
7,240,434 B2 * 7/2007 Lee et al. ..... 33/1 M
7,422,202 B2 * 9/2008 Wu ..... 269/303
7,717,386 B2 * 5/2010 Wang ..... 248/316.1
2006/0048363 A1 * 3/2006 Sogard ..... 29/407.1
2006/0157904 A1 * 7/2006 Li et al. ..... 269/8

* cited by examiner

*Primary Examiner* — George Nguyen
(74) *Attorney, Agent, or Firm* — Jeffrey T. Knapp

(57) ABSTRACT

An exemplary clamping apparatus includes a supporting body, a plurality of clamping units installed on the supporting body, a PWM controller, and a detection unit. Each clamping unit includes a magnet, a clamping pin, an electrical coil, and a coil core mechanically engaged with the clamping pin. The magnet is configured for holding the clamping pin at a target position. The PWM controller is configured for supplying a pulse signal to the respective electrical coil of each clamping unit and for thereby creating a magnetic force causing a corresponding coil core and a corresponding clamping pin to, synchronously, move. The detection unit is configured for detecting a back electromotive force representative of the arrival to the target position of a clamping pin and signaling the PWM controller to stop supplying the pulse signal. A clamping process utilizing the clamping apparatus is also provided.

14 Claims, 4 Drawing Sheets

CLAMPING APPARATUS WITH POSITION VALIDATION FUNCTION AND CLAMPING PROCESS USING SAME

BACKGROUND

1. Technical Field

The present invention relates to clamping apparatuses and clamping processes using the same and, particularly, to a clamping apparatus with a position validating function that could be used for clamping flat panel display substrates and a clamping process using the same.

2. Description of Related Art

Recently, in the flat panel display (FPD) manufacturing industry, conventional clamping apparatuses, including pneumatic actuators, have been widely used for clamping and positioning glass substrates. In a process of clamping and positioning a flat panel display substrate, e.g., a glass substrate, it would clearly be beneficial to possess an ability to detect whether the glass substrate has reached a target position or not, because that detection ability can help in effectively avoiding glass substrate breakage. If a clamping force or a pushing force continues to be applied to a glass substrate after the glass substrate has reached its target position, without the above-mentioned detection ability, the glass substrate would have increasing risks of breakage due to over-utilization of clamping force. As such, conventional clamping apparatuses, generally, have shortcomings in the area of position detection/validation function.

Therefore, what is needed is a clamping apparatus with a position detection/validation function and a clamping process using the same.

SUMMARY

A clamping apparatus, in association with a present embodiment, is provided. The clamping apparatus includes a supporting body, a plurality of clamping units installed on the supporting body, a PWM (i.e., Pulse Width Modulation) controller, and a detection unit. Each of the clamping units includes a magnet, a clamping pin, an electrical coil, and a coil core. The magnet is configured (i.e., structured and arranged) for holding the clamping pin at a target position, after the clamping pin has arrived at the target position. The clamping pin is mechanically engaged with the coil core. The PWM controller is configured for supplying a pulse signal to the electrical coil of each of the clamping units and for thereby creating a magnetic force. This magnetic force causes a corresponding coil core and a corresponding clamping pin to move toward or away, synchronously, from the electrical coil, along a central axis direction of the electrical coil. The detection unit is electrically connected with the electrical coil of each of the clamping units and the PWM controller. The detection unit is configured for detecting a back electromotive force representative of the arrival to the target position of a clamping pin and signaling the PWM controller to stop supplying the pulse signal to a corresponding electrical coil.

A clamping process utilizing the above described clamping apparatus, in associated with another present embodiment, is provided. The clamping process includes the steps: a) loading a substrate on the supporting body; b) supplying a pulse signal to the electrical coil of at least one of the clamping units by means of the PWM controller and thereby creating a magnetic attractive force to cause a corresponding coil core and a corresponding clamping pin to synchronously move toward the electrical coil; c) detecting a back electromotive force representative of the arrival to a target position of the corresponding clamping pin by means of the detection unit and signaling the PWM controller to stop supplying the pulse signal to the electrical coil; and d) holding the corresponding clamping pin at the target position by means of the magnet, via a magnetic force, and consequently clamping the substrate using the clamping pins of the clamping units.

Due to the fact that the clamping apparatus is endowed with a position detection/validation function, the clamping apparatus and clamping method, in association with the present embodiments, can effectively avoid substrate breakage in a clamping process.

Other advantages and novel features will become more apparent from the following detailed description of embodiments, when taken in conjunction with the accompanying drawings.

BRIEF DESCRIPTION OF THE DRAWINGS

Many aspects of the present clamping apparatus and clamping process can be better understood with reference to the following drawings. The components in the drawings are not necessarily drawn to scale, the emphasis instead being placed upon clearly illustrating the principles of the present clamping apparatus and clamping process. Moreover, in the drawings, like reference numerals designate corresponding parts throughout the several views.

The exemplifications set out herein illustrate various preferred embodiments, in various forms, and such exemplifications are not to be construed as limiting the scope of the present clamping apparatus and clamping process in any manner.

DETAILED DESCRIPTION

Figure 1:
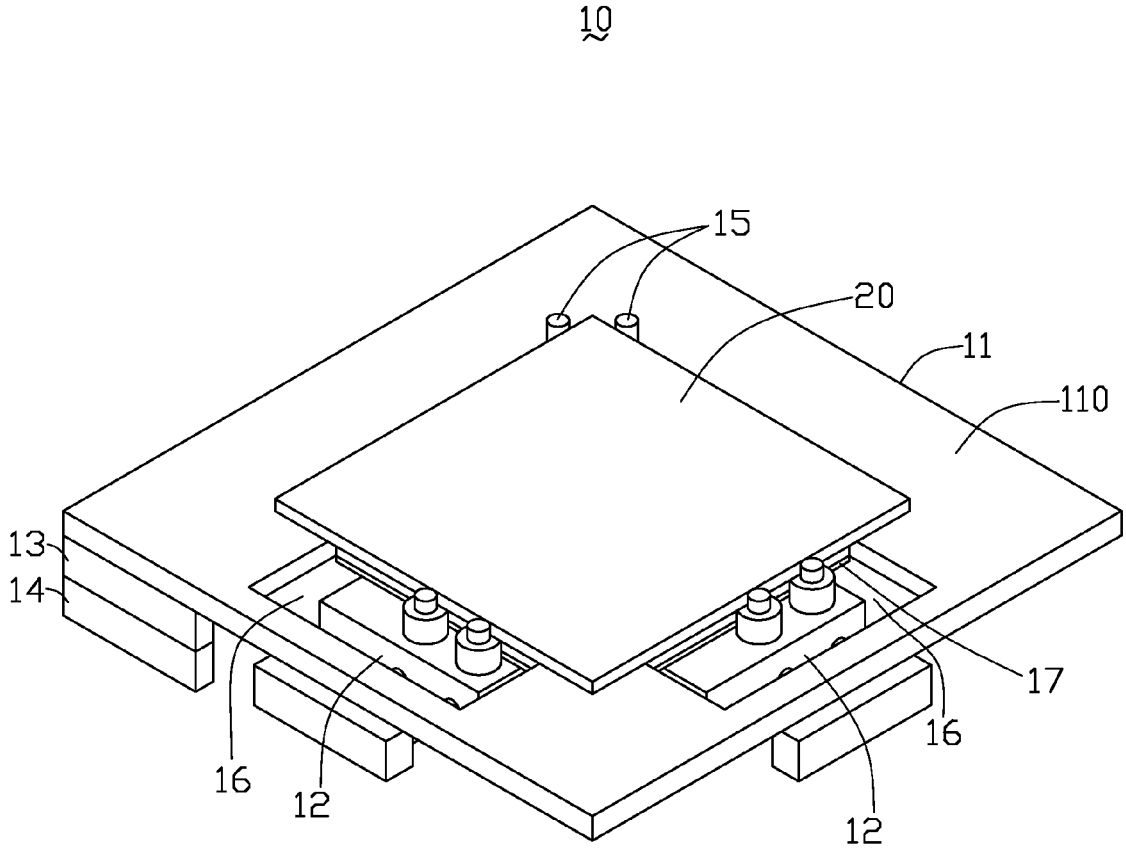
FIG. 1 is a schematic, isometric view of a clamping apparatus, in association with a present embodiment, showing the clamping apparatus including a PWM controller and a plurality of clamping units.
Figure 2:
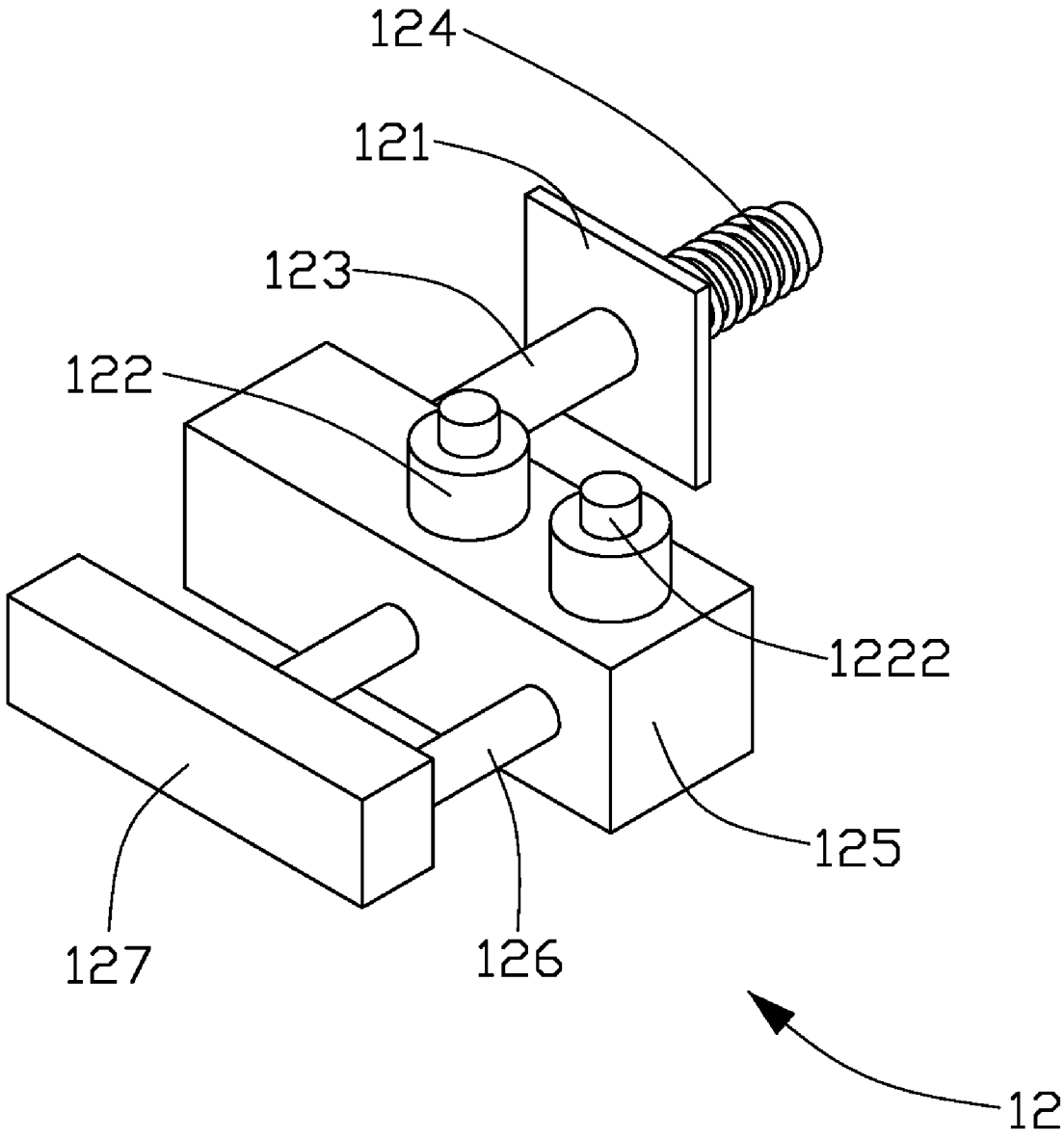
FIG. 2 is an isometric view of one of the clamping units of FIG. 1

Referring to FIGS. 1 and 2, a clamping apparatus 10, in associated with a present embodiment, is provided. The clamping apparatus 10 includes: a supporting body 11, a plurality of clamping units 12 installed on the supporting body 11, a PWM controller 13, and a detection unit 14.

The supporting body 11 defines a top surface 110 serving as a supporting surface and a bottom surface (not labeled) opposite to the top surface 110. Location pins 15 of the supporting body 11 are installed on the top surface 110 and are configured for receiving/positioning a corner of a substrate 20. In particular, each pin 15 is arranged so as to associate with a respective substrate side converging to form that corner. The supporting body 11 defines a plurality of through openings 16, each configured for facilitating the installment of the plurality of clamping units 12 on the supporting body 11. The through openings 16 penetrate through both the top surface 110 and the bottom surface. The supporting body 11 is configured for supporting the substrate 20, loaded on the top surface 110 thereof, in a clamping process.

Each clamping unit 12 is configured for holding/clamping a given side of the substrate 20. Further, each clamping unit 12 generally includes a magnet 121, at least one clamping pin 122, a coil core 123, and an electrical coil 124.

The magnet 121 is installed at a predetermined position of (i.e., thus directed toward) the bottom surface of the supporting body 11, so that the magnet 121 can effectively hold the at least one clamping pin 122 at a target position, via a magnetic force generated thereby. It is indicated that the magnet force generated from the magnet 121, suitably, has a magnitude which would not cause a movement of the at least one clamping pin 121 towards the magnet 121, when the at least one clamping pin 122 does not arrive at the target position. Advantageously, the magnet 121 defines a through hole therein. The through hole has a size allowing the coil core 123 to pass therethrough. The magnet 121, usefully, is a permanent magnet or an electromagnet.

The at least one clamping pin 122 is configured for clamping the substrate 20 loaded on the top surface 110, in a clamping process, and the at least one clamping pin 122 is aligned so as to be substantially perpendicular to each of the top surface 110 and the main surface of the substrate 20 received thereon. As illustrated in FIG. 2, two parallel clamping pins 122 are provided as part of each clamping unit 12. The clamping pins 122 are located in a through opening 16 and penetrate/extend through the top surface 110 (as shown in FIG. 1). Each of the two parallel clamping pins 122, beneficially, has a magnetic cylindrical profile, so as to clamp the substrate 20 loaded on the top surface 110 in a linear contact manner. In order to increase friction between the clamping pins 122 and the clamped substrate 20 with little risk of scratching the clamped substrate 20, a circumferential surface 1222 of each of the clamping pins 122 is, suitably, coated with rubber or another similar elastomer. The rubber/elastomer coating would also act to help relieve at least a small amount of overloading on the clamped substrate 20, if needed, and thus would serve as a further built-in safety measure within the present clamping system.

The coil core 123 is mechanically engaged with the two clamping pins 122, so as to drive the two clamping pins 122 to move synchronously therewith. The coil core 123, opportunely, is made from a magnetizable material. Advantageously, the coil core 123 is particularly made from a ferromagnetic material having magnetic memory effect. As illustrated in FIG. 2, the coil core 123 is engaged with the two clamping pins 122, by means of an engaging member 125. The engaging member 125 is engaged, in a sliding manner, with at least one guiding member 126, e.g., two guiding members 126. In particular, the two parallel clamping pins 122 and the coil core 123, respectively, are installed on two adjoining surfaces of the engaging member 125. The coil core 123 and the at least one guiding member 126, in turn, are located on opposite sides of the engaging member 125. A lengthwise direction of the two parallel clamping pins 122 is substantially perpendicular to that of the coil core 123. The engaging member 125 could linearly slide along the two guiding members 126. The two guiding members 126 are fixed on an installing member 127, disposed opposite and, usefully, parallel to the engaging member 125. The guiding members 126 are advantageously guiding rails (e.g., cylindrical or rectangular in shape). The installing member 127 is installed on/to the bottom surface of the supporting body 11 (e.g., via mechanical (e.g., bolts/screws) and/or metallurgical (e.g., welding/soldering) means).

The electrical coil 124 is configured for generating a magnetic force, causing the coil core 123 to move, selectably, toward or away from the electrical coil 123 along a central coil axis direction thereof. The electrical coil 124 is installed and fixed on the bottom surface of the supporting body 11, and the direction of the central coil axis, thereof, generally is coincides with an extending direction of the two guiding members 126. Advantageously, in order to avoid heat dissipation from the electrical coil 124, in operation, into the substrate 20 loaded on the top surface 110, a thermal isolator 17 is interposed between the electrical coil 124 and the bottom surface of the supporting body 11.

The PWM controller 13 is electrically/electronically connected (e.g., hard-wire or wireless connection) with the electrical coil 124 of each of the clamping units 12. The PWM controller 13 is programmable and configured for supplying an adjustable pulse signal, e.g., a pulsed current to the electrical coil 124 of each of the clamping units 12. Due to the fact that the PWM controller 13 is programmable, an electrical parameter of the pulse signal, for example, including a duty ratio, is adjustable, and thereby a magnetic force generated from the electrical coil 124 and applied to the coil core 123 is adjustable. In other words, a clamp force of at least one clamping pin 122 of each of the clamping units 12 can be selectably varied.

The detection unit 14 is electrically/electronically connected with the electrical coil 124 and the PWM controller 13. The detection unit 14 is configured for detecting a back electromotive force representative of the arrival to the target position of the at least one clamping pin 122 of a corresponding clamping unit 12 and thus signaling the PWM controller 13 to stop supplying the pulse signal to a corresponding electrical coil 124. The detection unit 14, suitably, includes a sampling signal emitter, a sampling signal receiver, and a switch controlling circuit (not individually shown). The sampling signal emitter and the sampling signal are electrically/electronically connected with the electrical coil 124, via the switch controlling circuit.

Figure 3:
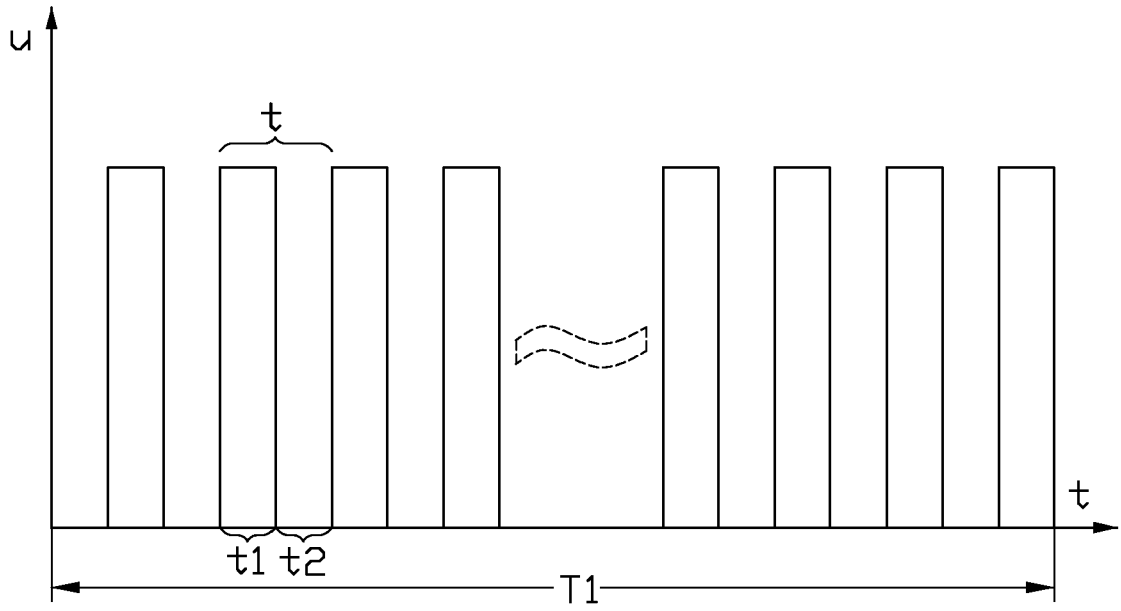
FIG. 3 is a waveform and timing diagram of a pulse signal outputted from the PWM controller of FIG. 1, in a present clamping process.

A clamping process using the above-described clamping apparatus 10 will be described in detail, with references further made to FIGS. 3 and 4. It is noted that, since a clamping process of each of the clamping units 12 is similar to each other, clamping process for only one clamping unit is described, as follows, for the purpose of illustration.

Referring to FIGS. 1 and 2, after a substrate 20 is loaded on the top surface 110 of the supporting body 11, the PWM controller 13 outputs a periodic first pulse signal, e.g., pulsed current to the electrical coil 124 of the clamping unit 12. The electrical coil 124 generates a magnetic attraction force when the first pulse signal passes therethrough and thereby causes the coil core 123 to move towards the electrical coil 124, along the central coil axis direction of the electrical coil 124. Each clamping pin 122, synchronously, moves towards the electrical coil 124, with the coil core 123 and under the traction of the coil core 123. In particular, as illustrated in FIG. 3, during a time interval of T1, the first pulse signal outputted from the PWM controller 13 has a period of t and a duty ratio t1/t (i.e., a ratio of t1 dividing t). In each period of t, an amplitude value of the first pulse signal in time interval of t1 is different from that in time interval of t2, so the periodic first pulse signal is equivalent to a time-varying signal in each period of t. As a result, when the time-varying signal is supplied to the electrical coil 124, a magnetic field will be generated from the electrical coil 124, based upon the Faraday's Law (i.e., the law of electromagnetic induction). The coil core 123 would be magnetized by the magnetic field, and, accordingly, a magnetic attraction force is formed between the coil core 123 and the electrical coil 124. Thereafter, the coil core 123 will move towards the electrical coil 124, under an effect of the magnetic attractive force, at a condition of the electrical coil 124 being installed and fixed on the supporting body 11. Generally, during the movement of the coil core 123 going towards the electrical coil 124, the electrical coil 124 would generate an electromotive force, due to the fact that the coil core 123 cuts/intersects magnetic lines of force produced from the electrical coil 124. Based upon Lenz's law, such an electromotive force, generally, is termed as back electromotive force (i.e., back-EMF).

In one example, the at least one clamping pin 12, first, contacts the substrate 20 after the time interval of T1 and arrives at the target position at that same time. Because of a blocking effect of the location pins 15, the at least one clamping pin 12 is blocked from moving, and the coil core 123, correspondingly, is instantly stopped from moving toward the electrical coil 124. Consequently, the back electromotive force induced in the electrical coil 124 instantly drops down to a certain level (i.e., a level that will not promote further core movement). The detection unit 14 will detect the level of the back electromotive force and signal the PWM controller 13 that the at least one clamping pin 12 has arrived at the target position. As such, a position detection/validation function is achieved. The PWM controller 13 suitably stops supplying the periodic first pulse signal to the electrical coil 124 after being signaled by the detection unit 14, and, as such, the magnetic attraction force generated from/by the electrical coil 124 is withdrawn. The at least one clamping pin 122 will be held by the magnet 121 via a magnetic attraction force.

Figure 4:
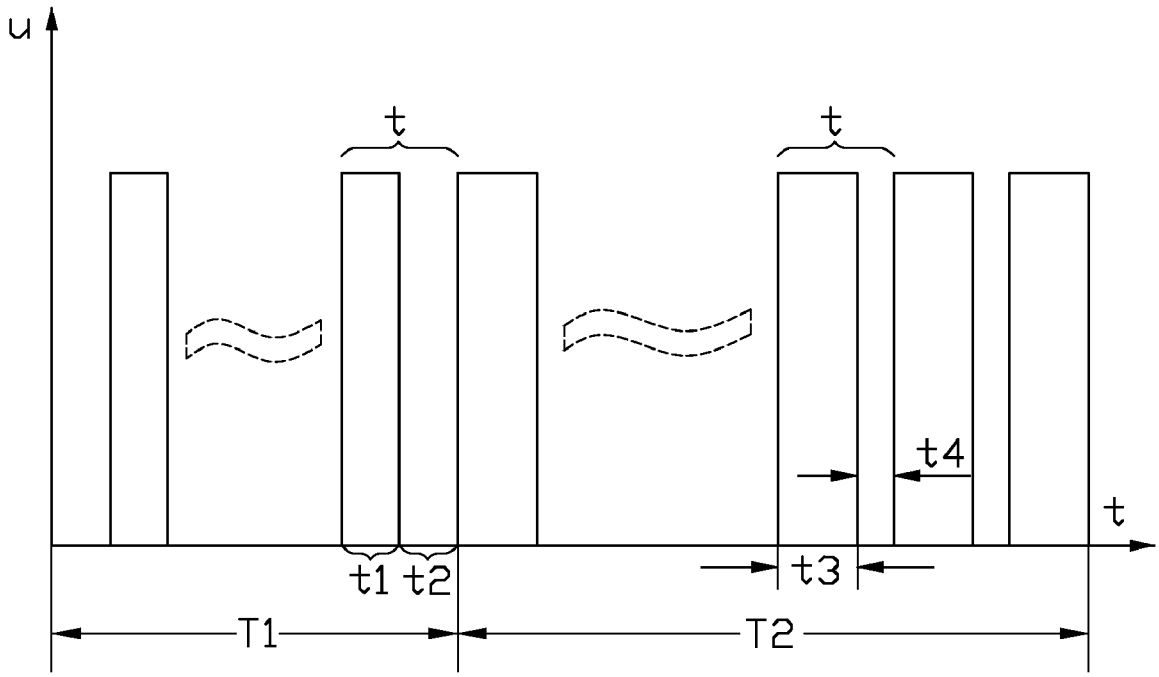
FIG. 4 is another waveform and timing diagram of a pulse current output from the PWM controller of FIG. 1, in another present clamping process.

In another example, if the at least one clamping pin 12 still does not arrive at the target position when the at least one clamping pin 12 first contacts the substrate 20, the duty ratio t1/t of the periodic first pulse signal, advantageously, is adjusted to be t3/t, as illustrated in FIG. 4, wherein t3+t4=t, and t3>t1. Hereinafter, the periodic pulse signal with a duty ratio of t3/t is referred to as a periodic second pulse signal. Due to the larger duty ratio of t3/t, a larger magnetic attractive force is applied to the coil core 123, and the at least one clamping pin 122 is correspondingly endowed with a larger clamp force. The at least one clamping pin 122 will push the substrate 20 to move, synchronously, therewith. After the time interval of T2, the at least one clamping pin 122 will arrive at the target position. Thereafter, the coil core 123 will instantly stop moving toward the electrical coil 124, and a back electromotive force induced in the electrical coil 124 will, consequently, instantly drop down to a certain level. The detection unit 14 will detect the back electromotive force with the certain level and signal the PWM controller 13 that the at least one clamping pin 12 has arrived at the target position. The PWM controller 13 stops supplying the periodic second pulse signal to the electrical coil 124 after being signaled by the detection unit 14, and, thus, the magnetic attractive force generated from/by the electrical coil 124 is withdrawn. The at least one clamping pin 122 will be held by the magnet 121 via a magnetic attraction force.

It is understood that, in order to unload the substrate 20 from the supporting body 11, the substrate 20 can be released by way of supplying a reverse periodic pulse signal to the electrical coil 124. The electrical coil 124 will generate a reverse magnetic field that is repulsive to the magnetic field generated from the magnetized coil core 123. As a result, a magnetic repulsive force is applied to coil core 123. The coil core 123 and the at least one clamping pin 122 are driven to move away from the electrical coil 124 by the magnetic repulsive force, and, consequently, the substrate 20 is released.

In summary, the clamping apparatus 10, in association with the present embodiment is endowed with a position detection/validation function, which can effectively avoid or at least greatly curtail the opportunity for substrate breakage in a clamping process. Furthermore, a clamping force of each of the clamping units 12, e.g., an attractive magnetic force, is adjustable resulting from the programmable PWM controller 13, which facilitates a clamping operation of the substrate in different clamping processes.

It is believed that the present embodiments and their advantages will be understood from the foregoing description and it will be apparent that various changes may be made thereto without departing from the spirit and scope of the invention or sacrificing all of its material advantages, the examples hereinbefore described merely being preferred or exemplary embodiments of the present invention.

What is claimed is:

1. A clamping apparatus, comprising:

a supporting body;

a plurality of clamping units installed on the supporting body, each clamping unit including a magnet, a clamping pin, an electrical coil, and a coil core, the magnet being configured for holding the clamping pin at a target position, the clamping pin being mechanically engaged with the coil core;

a PWM controller configured for supplying a pulse signal to the electrical coil of each clamping unit and for thereby creating a magnetic force, the magnetic force causing a corresponding coil core and a corresponding clamping pin to, synchronously, selectably move toward or away from the electrical coil, along a central axis direction of the electrical coil; and a detection unit electronically connected with the electrical coil of each clamping unit and the PWM controller, the detection unit being configured for detecting a back electromotive force representative of the arrival to a target position of a clamping pin and for signaling the PWM controller to stop supplying the pulse signal to a corresponding electrical coil.

2. The clamping apparatus of claim 1, wherein each clamping unit further comprises an engaging member, a guiding member, and an installing member, the clamping pin and the coil core being, respectively, fixed on two adjoining surfaces of the engaging member and extending along two substantially perpendicular directions, the engaging member being engaged, in a sliding manner, with the guiding member, the guiding member being fixed to the supporting body via the installing member.

3. The clamping apparatus of claim 2, wherein the supporting body defines a supporting surface and a plurality of through openings penetrating through the supporting surface, the clamping pin of each clamping unit being located in a corresponding through opening and penetrates through the supporting surface, the clamping pin of each clamping unit is substantially perpendicular to the supporting surface.

4. The clamping apparatus of claim 3, wherein the supporting body further comprises a plurality of location pins fixed on the supporting surface, and the location pins are configured for carrying out a clamping function by co-acting with the clamping pins of the clamping units in a cooperative manner.

5. The clamping apparatus of claim 1, further comprising a thermal isolator, the thermal isolator being interposed between the supporting body and the electrical coil of each clamping unit.

6. The clamping apparatus of claim 1, wherein the coil core of each clamping unit is made from a magnetizable material.

7. The clamping apparatus of claim 1, wherein the magnet of each clamping unit is selected from the group consisting of a permanent magnet and an electromagnet.

8. The clamping apparatus of claim 1, wherein the magnet of each clamping unit defines a through hole therein, and the through hole has a size allowing a corresponding coil core to pass therethrough.

9. A clamping process employing a clamping apparatus, the clamping apparatus including a supporting body, a plurality of clamping units installed on the supporting body, a PWM controller, and a detection unit, each clamping unit comprising a magnet, a clamping pin, a coil core, and an electrical coil, the clamping process comprising the steps of:

loading a substrate on the supporting body;

supplying a pulse signal to a respective electrical coil of at least one of the clamping units by means of the PWM controller and thereby creating a magnetic attractive force to cause a corresponding coil core and a corresponding clamping pin to, synchronously, move toward the electrical coil;

detecting a back electromotive force representative of the arrival to a target position of the corresponding clamping pin, the detecting being achieved by means of the detection unit;

signaling the PWM controller to stop supplying the pulse signal to the electrical coil upon detecting a given back electromotive force representative of the arrival to the target position; and holding the corresponding clamping pin at the target position by means of the magnet via a magnetic force.

10. The clamping process of claim 9, before the detection step, further comprising a step of:

supplying to the electrical coil another pulse signal having a larger duty ratio, when the corresponding clamping pin contacts with the substrate.

11. The clamping process of claim 9, after the holding step, further comprising a step of:

supplying a reversed pulse signal to the electrical coil and thereby creating a magnetic repulsive force to cause the corresponding coil core and the corresponding clamping pin to, synchronously, move away from the electrical coil.

12. A clamping apparatus, comprising:

a supporting body;

a plurality of clamping units installed on the supporting body, each clamping unit including:

a magnet, a clamping pin, an electrical coil, and a magnetizable member, the magnet being configured for holding the clamping pin at a target position after the clamping pin has arrived at the target position, the clamping pin being mechanically engaged with the magnetizable member, the electrical coil being fixed on the supporting body, the magnetizable member being movable relative to the electrical coil;

a controller configured for supplying a pulse signal to the respective electrical coil of each clamping unit and for thereby selectably magnetizing or demagnetizing a corresponding magnetizable member in order to cause a synchronous movement of the corresponding magnetizable member and a corresponding clamping pin; and a detection unit electrically connected with the respective electrical coil of each clamping unit and the controller, the detection unit being configured for detecting a back electromotive force representative of the arrival of the target position of a clamping pin and for signaling the controller to stop supplying the pulse signal to a corresponding electrical coil.

13. The clamping apparatus of claim 12, wherein the magnetizable member is made from a ferromagnetic material.

14. The clamping apparatus of claim 12, wherein the controller is a programmable PWM controller.

* * * * *